US005865021A

United States Patent [19]

Duerigen et al.

[11] Patent Number: 5,865,021

[45] Date of Patent: Feb. 2, 1999

[54] COATED ROLLER CHAIN PIN

[75] Inventors: Robert T. Duerigen; Andrew J. Binford, both of Indianapolis, Ind.

[73] Assignee: AMSTED Industries Incorporated, Chicago, Ill.

[21] Appl. No.: 917,307

[22] Filed: Aug. 25, 1997

[51] Int. Cl.[6] ..... F16G 13/06

[52] U.S. Cl. ..... 59/4; 59/5; 59/8; 59/35.1; 59/901

[58] Field of Search ..... 59/4, 5, 8, 35.1, 59/901; 474/206

[56] References Cited

U.S. PATENT DOCUMENTS 4,615,171 10/1986 Burk ..... 59/4

FOREIGN PATENT DOCUMENTS 0039920 4/1978 Japan ..... 59/35.1
0006939 1/1981 Japan ..... 59/4
0224738 1/1981 Japan ..... 59/35.1
0259247 10/1988 Japan ..... 59/5

*Primary Examiner*—David Jones
*Attorney, Agent, or Firm*—Edward J. Brosius; F. S. Gregorczyk; Stephen J. Manich

[57] ABSTRACT

The present invention relates to the case hardening, tempering and coating of a medium carbon alloy chain pin. A medium carbon alloy chain pin is provided and is case hardened to a selected radial depth. The case hardened chain pin is quenched and then tempered to introduce a gradient from the surface of the chain pin inwardly in carbon content and hardness. The chain pin is then coated with an electroless nickel and fluorinated carbon co-deposition to increase surface hardness.

14 Claims, 1 Drawing Sheet

COATED ROLLER CHAIN PIN

BACKGROUND OF THE INVENTION

The present invention relates generally to roller chain and, more particularly, to roller chain pins that are carburized and otherwise heat treated to allow for subsequent coating of a hardened electroless nickel enhanced with a fluorinated carbon as a co-deposit without the sacrifice of requisite metallurgical properties of the roller chain pin.

As will be described in more detail in the detailed description of the present invention, roller chain is normally made up of five components. These components include alternating inside and outside links. The inside links are press fit over bushings and are usually called roller links. The outside links are typically press fit over pins and hence are typically called pin links. Cylindrical rollers are provided outside the bushings leaving the rollers free to turn for a rolling action as the roller chain enters and exists the driving sprockets.

Typically, all high quality components of roller chain, including pins, bushings and rollers, are carburized or case hardened Link plates are thru-hardened. The carburizing process allows the outside of the parts to be transformed to a hard, wear resistant surface whereas the inner core retains the tough and ductile properties of the metal to absorb normal shock loading. In most applications, this combination provides the necessary engineered balance between wear resistance, durability and strength. In efforts to improve the overall performance of roller chain, including improvements in wear life, galling resistance and overall lubricity of the roller chain pins various types of coatings were reviewed. After reviewing the constraints of the design of the roller chain product, performance and manufacturing techniques available, the use of electroless nickel as an autocatalytic deposition was settled on as most desirable to provide corrosion protection on carbon and alloy steel roller chain pins. This was found to be superior to electroplating because of potential for embrittlement in electroplating. Further, tooling treatments such as titanium nitride were viewed as inappropriate due to the manner of application and the labor intensive requirements. Further, flame spraying and ion implantation have similar undesirable restrictions on roller chain manufacture.

Further, a co-deposit of a material to provide lubricity was also desirable. Various components such as silicon carbide, fluorinated carbon and polytetrafluoroethylene were all reviewed. It was decided that the polytetrafluoroethylene or other similar proprietary coatings available today were best suited as a co-deposit with the electroless nickel for the roller chain pins.

The major problem faced in the electroless nickel operation is the need to harden the electroless nickel fluorinated carbon co-deposition at temperatures in the neighborhood of 600°–750° F. to achieve maximum hardness and wear resistance. As most roller chain pins are tempered at 300°–350° F., such subsequent hardening of the electroless nickel coating would result in a reduction of the pin core hardness and strength.

SUMMARY OF THE INVENTION

It is an object of the present invention to provide a roller chain and a method of manufacturing the roller chain with a roller chain pin that is capable of being coated in a co-deposition operation including electroless nickel and a selected fluorinated carbon component without loss of desirable roller chain pin metallurgical properties.

As stated above, roller chain is normally made of five components. These components include outside or pin links joined by cylindrical pins, inside or roller link plates joined by cylindrical bushings, the pins themselves extending between openings in outside links and the bushings themselves extending between openings in the inside links. The cylindrical rollers themselves are provided which rotate about the bushings. Such roller chain is typically made of carbon or various alloy steels, and various coatings such as plating, electroless nickel and hard chroming, bluing, epoxy coating and even passivation (stainless steels as chain components) have been used on various types of roller chain for particular applications. It is desirable to improve the wear life, galling resistance and lubricity of the roller chain pins themselves by the use of special coatings. An ideal coating would include the wear resistance and corrosion protection provided by an electroless nickel autocatalytic deposition, with improved lubricity. Co-depositions usually utilized with the electroless nickel operation include fluorinated carbons and polytetrafluoroethylene.

In preparing the roller chain pin for the electroless nickel co-deposition process, it is necessary to prepare the pin for the ultimate hardening of the electroless nickel operation that typically occurs at 700°–750° F. The inventive preparation includes the carburizing of a medium carbon alloy chain pin of an alloy from 0.40% to 0.45% carbon by exposing the chain pin to a carburizing atmosphere. The chain pin is thereby case hardened to a radial depth of from 7% to 10% of its diameter inwardly from its outside surface. The chain pin is then typically direct quenched in oil and then tempered to introduce a gradient from the surface of the chain pin inwardly in carbon content from about 0.80% to about 0.40% and in hardness from a surface hardness of about 50 HRC to about 45 HRC at the inward percentage maximum depth of the case hardening. The thusly case hardened and prepared roller chain pin can then be coated with a coating such as electroless nickel co-deposited with a polytetrafluroethylene or similar lubricity adding compound and subsequently hardening such surface coating by heating operation at about 600°–750° F. The prepared roller chain will maintain its necessary strength and ductility while achieving a surface hardness of from 52–56 HRC with attendant lubricity properties of the fluorinated carbon co-composition material.

DETAILED DESCRIPTION OF THE INVENTION

Figure 1:
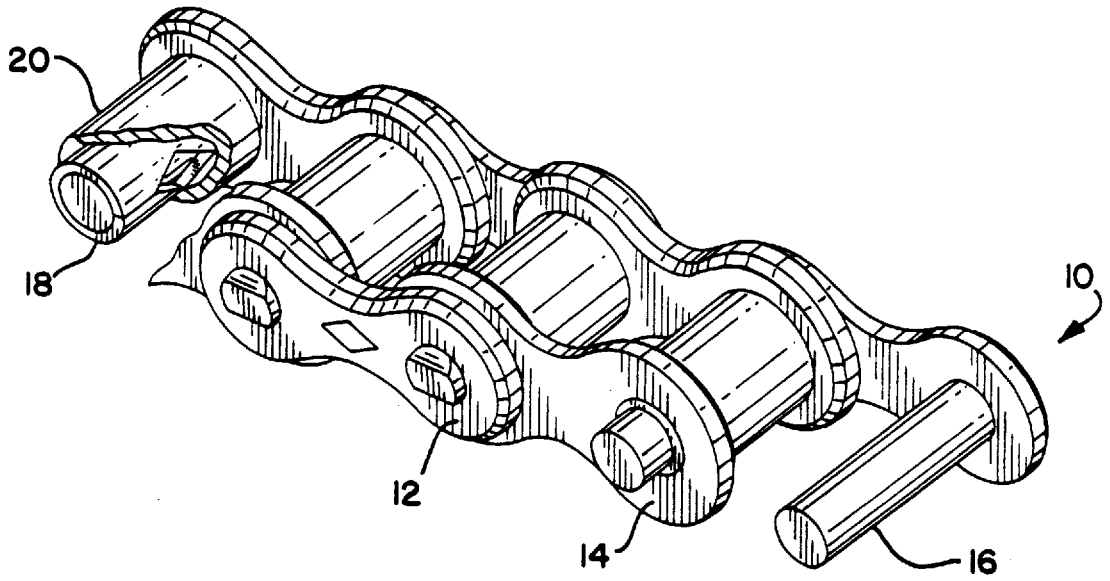
FIG. 1 is a perspective view and partial cross section of a roller chain showing appropriate components.

Referring now to FIG. 1 of the drawing, a roller chain is shown generally at 10. The roller chain is comprised of alternate outside links 12 and inside links 14. Outside links 12 include openings into which the ends of pins 16 extend and are crimped in place. In certain applications of roller chain, the ends of pins 16 can extend further beyond outside links 12 and be held in place by cotter pins. Inside links 14 include openings into which bushings 18 are press fit. Cylindrical rollers 20 extend about bushings 18 and are free to rotate as the pin enters and exits the appropriate drive sprockets. A usual material for such roller chain components is medium carbon steel, such as type AISI 8642. However, various other steels or stainless steels can be used depending on the application. Pins 16 are usually sheared from selected wire or rod stock.

Due to the requirement for the roller chain pins to be subsequently electroless nickel with co-deposit coated with subsequent hardening at temperatures of 600°–750° F., it is generally desirable to begin with a roller chain pin material of medium carbon steel, such as AISI 8642. Such steel contains from 0.40% to 0.45% carbon. The medium carbon pins are case hardened and subsequently tempered to provide a substrate with a rich carbon surface and a gradient decreasing in carbon hardness from the surface. The carburizing itself is usually performed in a gas carburizing operation preferably at a carbon atmosphere of 0.85% at 1700° F. for about two hours. This provides case hardening of the roller chain pin to a radial depth of from 7% to 10% of its diameter inwardly from its outside surface. After such carburizing, the roller chain pin is usually direct quenched in oil. The case hardened chain pin is then tempered at usually from 700°–750° F. for a period of about one hour. Such tempering introduces a gradient from the surface of the roller chain pin inwardly in carbon content from about 0.85% at the outer surface of the pin to about 0.40% at the inward depth of the case hardening. Further, the surface hardness of the roller chain pin decreases over a similar percentage of depth from about 50 HRC at the surface to about 45 HRC at the depth of the case hardening effect.

Such prepared roller chain pins are then coated in a co-deposition process usually of electroless nickel and polytetrafluoroethylene or a WEAR-COTE PLUS® operation available from the WEAR-COTE International, Inc. of Rock Island, Ill. Such WEAR-COTE PLUS® operation is described in U.S. Pat. No. 4,830,889. The electroless nickel co-deposition with fluorinated carbon operation is followed by a heating operation at from 600°–750° F. The resulting pins have a relatively hard surface of from 52 to 56 HRC with attendant lubricity property due to the co-deposited fluorinated carbon.

Such specially prepared pins could be coupled with variously selected bushings to provide improved wear life at normal or even elevated roller chain service temperatures of up to 475° F.

A specific example of the method of the present invention will now be set forth.

EXAMPLE 1

Medium carbon roller chain pins of AISI 8642 steel containing from 0.40% to 0.45% carbon were selected in a size of 1.005 in. length by 0.2355 in diameter. These pins were case hardened in a carburizing atmosphere with a carbon potential of 0.85% at 1700° F. for one hour and 50 minutes. The case hardened pins were then direct quenched in oil. The depth of case hardening was from 0.18 to 0.22 in. which is 7.6% to 9.3% of the diameter. The roller chain pins were then tempered at 700° F. for one hour. The resulting surface hardness was 50 HRC and the hardness at a depth of about 10% diameter was 46 HRC. The pins were then subjected to a co-deposition operation of electroless nickel and polytetrafluoroethlene and subsequently heated at 700° F. for one hour. This resulted in roller chain pins of a surface hardness of from 52 to 56 HRC. When assembled in to roller chain, the static chain tensile strength was still higher then the requisite 8500 lbs. minimum required for such standard size roller chain with case hardened pins.

What is claimed is:

1. A method of case hardening a medium carbon alloy chain pin comprising the steps of:

providing a medium carbon alloy chain pin of 0.40% to 0.45% C, case hardening said chain pin by exposing said chain pin to carburizing atmosphere thereby case hardening said chain pin to a radial depth of 7% to 10% of its diameter, tempering said case hardened chain pin to introduce a gradient from the surface of the chain pin inwardly in carbon content of about 0.85% at the surface to about 0.40% and in hardness from about 50 HRC to about 45 HRC, and coating said pin with a hardening coating that increases the surface hardness to 52 to 56 HRC.

2. The method of claim 1 wherein said medium carbon alloy chain pin is an AISI 8642 alloy steel.

3. The method of claim 1 wherein the carburizing step is performed in an atmosphere with a carbon potential of about 0.85%, at a temperature of about 1700° F. for a period of about one hour and 50 minutes.

4. The method of claim 1 wherein the tempering is at about 700° F. for about one hour.

5. The method of claim 1 wherein said hardening coating comprises an electroless nickel and polytetrafluoroethylene following by a heating at about 750° F. for about one hour.

6. The method of claim 1 wherein said hardening coating comprises a WEAR-COTE PLUS® coating followed by heating at about 700° F. for about one hour.

7. The method of claim 1 wherein said chain pin is direct quenched in oil after the case hardening.

8. A chain pin produced by a process comprising the steps of providing a medium carbon alloy chain pin of 0.40% to 0.45% C, case hardening said chain pin by exposing said chain pin to a carburizing atmosphere thereby case hardening said chain pin to a radial depth of 7% to 10% of its diameter, tempering said case hardened chain pin to introduce a gradient from the surface of the chain pin inwardly in carbon content of about 0.85% at the surface to about 0.40% and in hardness from about 50 HRC to about 45 HRC, and coating said chain pin with a hardening coating that increases the surface hardness to 52 to 56 HRC.

9. The chain pin of claim 8 wherein said medium carbon alloy chain pin is an AISI 8642 alloy steel.

10. The chain pin of claim 8 wherein the carburizing step is performed in an atmosphere with a carbon potential of about 0.85%, at a temperature of about 1700° F. for a period of about 1 hour and 50 minutes.

11. The chain pin of claim 8 wherein the tempering is at about 700° F. for about one hour.

12. The chain pin of claim 8 wherein said hardening coating comprises an electroless nickel and polytetrafluoroethylene following by a heating at about 750° F. for about one hour.

13. The chain pin of claim 8 wherein said coating comprises a WEAR-COTE PLUS coating followed by heating at about 700° F. for about one hour.

14. The chain pin of claim 8 wherein said chain pin is direct quenched in oil after the case hardening.

* * * * *